US006256831B1

(12) United States Patent
Chen

(10) Patent No.: US 6,256,831 B1
(45) Date of Patent: Jul. 10, 2001

(54) BATH SCRUBBER

(75) Inventor: Kuo-Chin Chen, Taipei (TW)

(73) Assignee: Confirm Personal Care Industrial Corp., Taoyuan Hsien (TW)

( * ) Notice: Subject to any disclaimer, the term of this patent is extended or adjusted under 35 U.S.C. 154(b) by 0 days.

(21) Appl. No.: 09/334,712

(22) Filed: Jun. 16, 1999

(51) Int. Cl.[7] ..... A47K 7/02

(52) U.S. Cl. ..... 15/244.3; 15/118; 15/209.1; 15/229.11

(58) Field of Search ..... 15/244.3, 118, 15/208, 209.1, 229.11

(56) References Cited

U.S. PATENT DOCUMENTS 2,875,461 * 3/1959 Anderson ..... 15/118
3,857,133 * 12/1974 Linenfelser ..... 15/118
4,244,074 * 1/1981 Barcikowski et al. ..... 15/118
5,408,718 * 4/1995 Sadovsky ..... 15/244.3
5,439,487 * 8/1995 Stanitzok ..... 15/208
5,591,507 * 1/1997 Jones ..... 15/208
5,671,498 * 9/1997 Martin et al. ..... 15/244.3
5,725,927 * 3/1998 Zilg et al. ..... 15/209.1
5,804,274 * 9/1998 Nordin ..... 15/208
5,991,962 * 11/1999 Nakatani ..... 15/244.3

* cited by examiner

*Primary Examiner*—Randall E. Chin
(74) *Attorney, Agent, or Firm*—Pro-Techtor International Services

(57) ABSTRACT

A bath scrubber includes an outer bag and a sponge received in the outer bag. The outer bag is made of a fabric woven from thin and thick yarns of twisted artificial fibers. The thin yarns are densely woven to form a base of the fabric, and the thick yarns are evenly woven into and distributed among said thin yarns, such that the thick yarns intersect one another to divide the base of the fabric densely woven from the thin yarns into a plurality of separated small areas, and intersections of the thick yarns are wound by the thin yarns. The small areas enclosed by the thick yarns allow more bubbles to be held on the bath scrubber for a prolonged time. A difference in height exists between the thin yarns and the thick yarns to give the outer bag of the bath scrubber a rough surface that enables good cleaning and massaging effect on a user's skin.

7 Claims, 4 Drawing Sheets

A - A'

B

BATH SCRUBBER

FIELD OF THE INVENTION

The present invention relates to a bath scrubber, and more particularly to a bath scrubber that has the ability to produce and gather bubbles thereon to provide a good cleaning and massaging effect.

BACKGROUND OF THE INVENTION

In the description hereunder, the term "bath scrubber" shall mean a device on which a cleaning product, such as a solid or liquid soap, may be applied for cleaning a user's body by frictionally contacting the device with the user's skin.

FIG. 1 illustrates a conventional bath scrubber 1 that includes an upper surface fabric 11 and a lower surface fabric 12 that are sewed up along their outer periphery to completely cover a sponge (not shown). It is the sponge that forms a main body of the bath scrubber 1 to hold sufficient amount of water in the bath scrubber 1. The upper and the lower surface fabrics 11 and 12, in addition to be used for covering the sponge, are used to frictionally contact with and thereby clean a user's skin. Such a conventional bath scrubber has at least the following disadvantages:

1. Both the upper and the lower surface fabrics 11, 12 are woven cloth material and therefore have a very fine texture that is not rough enough to really frictionally contact with and clean the user's skin. It is only the cleaning product, that is, the solid or liquid soap, applied on the surface fabric 11 or 12 that has cleaning effect on the user's skin. The user's skin is not really scrubbed. In other words, the conventional bath scrubber 1 does not provide good cleansing effect.
2. The surface fabrics 11 and 12 made of woven cloth material usually have high density and tight texture and therefore have inferior ability of gathering and holding bubbles. Only a low quantity of tiny bubbles can be held on the conventional bath scrubber of FIG. 1. This means an increased amount of cleaning product will be needed or an additional amount of cleaning product must be added to the surface fabrics 11, 12 to produce more bubbles on the bath scrubber 1. This forms an unnecessary waste of the cleaning product.
3. The surface fabrics 11 and 12 made of woven cloth material have fine and smooth surfaces that do not provide any massage effect on the user's skin.

It is therefore the intention of the inventor to develop a bath scrubber that has a suitably formed rough surface to gather and hold more bubbles for thoroughly cleaning the user's skin and provide good frictional contact with the user's skin to massage the same.

SUMMARY OF THE INVENTION

A primary object of the present invention is to provide a bath scrubber having an outer bag made of a fabric woven from thin and thick yarns of twisted artificial fibers. The thin yarns are densely woven to form a base of the fabric and the thick yarns are evenly distributed among the thin yarns to divide the fabric into a plurality of small areas. These divided small areas among the thick yarns enable gathering and holding of more big bubbles on the outer bag of the bath scrubber to facilitate effective cleaning with reduced amount of cleaning product.

Another object of the present invention is to provide a bath scrubber having an outer bag made of a fabric woven from thin and thick yarns of twisted artificial fibers. A difference in height exists on the fabric between the thin and the thick yarns and gives the outer bag a rough surface that frictionally contacts with the user's skin to properly massage the same while removing impurities from the skin.

To achieve the above and other objects, the bath scrubber of the present invention mainly includes an outer bag and a sponge received in the outer bag. The outer bag is made of a fabric woven from thin and thick yarns of twisted artificial fibers. The thin yarns are densely woven to form a base of the fabric, and the thick yarns are evenly woven into and distributed among said thin yarns, such that the thick yarns intersect one another to divide the base of the fabric densely woven from the thin yarns into a plurality of separated small areas, and intersections of the thick yarns are wound by the thin yarns. The divided small areas among the thick yarns allow more bubbles to be held on the bath scrubber for a prolonged time. A difference in height exists on the fabric between the thin yarns and the thick yarns to give the fabric and therefore the outer bag of the bath scrubber a rough surface that enables good cleaning and massaging effect on a user's skin.

DETAILED DESCRIPTION OF THE PREFERRED EMBODIMENTS

Figure 1:
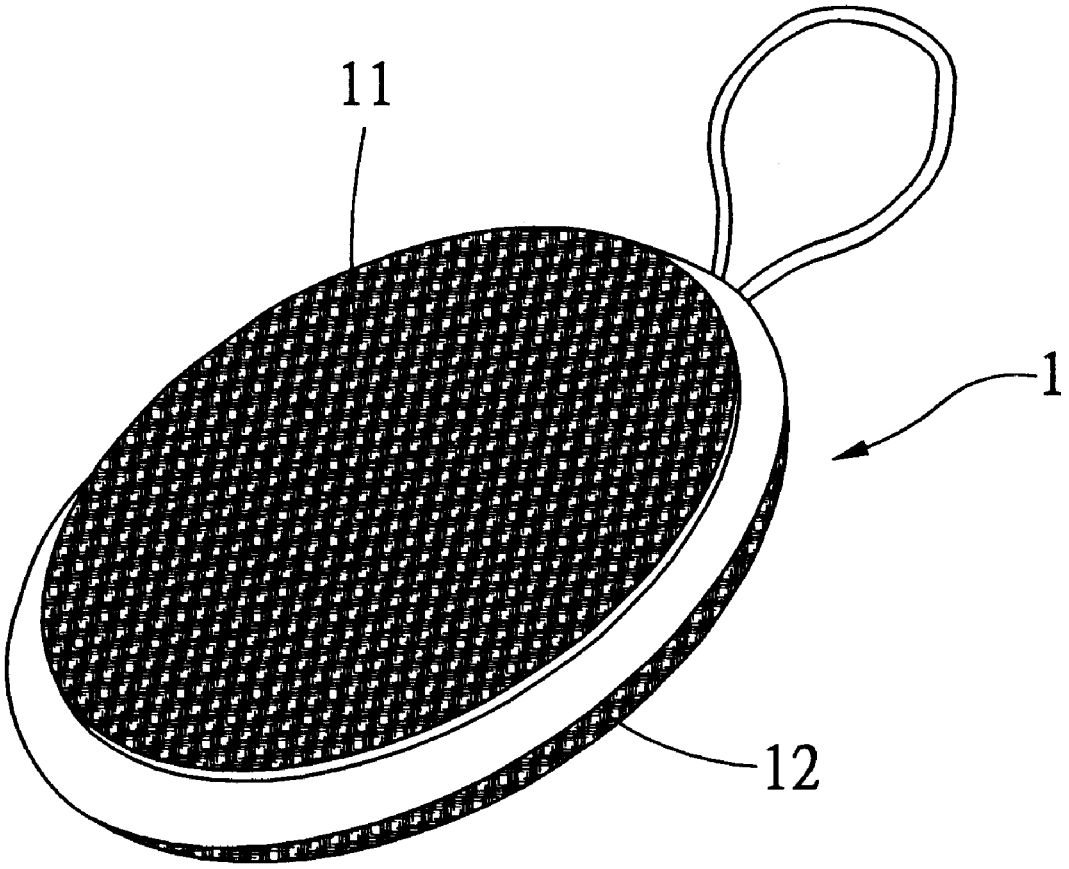
(PRIOR ART) Fig.1
FIG. 1 is a perspective of a conventional bath scrubber.
Figure 2:
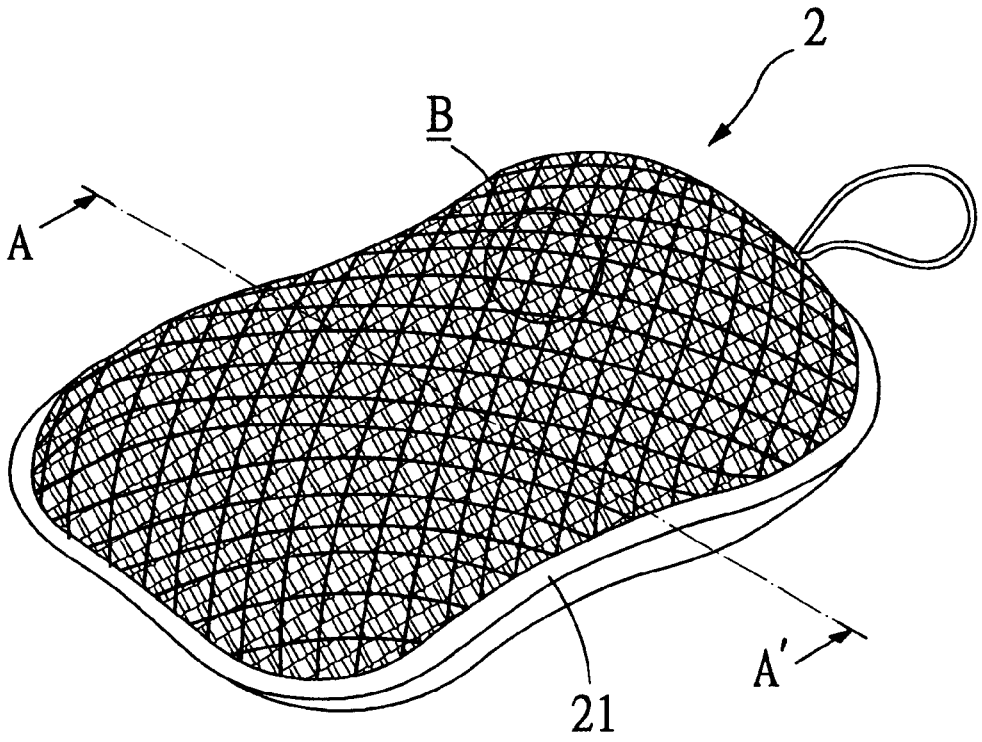
FIG. 2 is a perspective of a bath scrubber according to the present invention.
Figure 3:
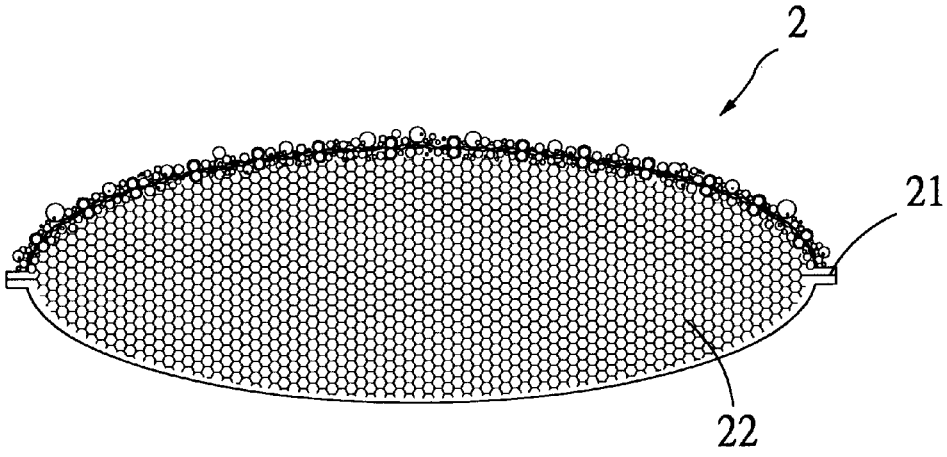
FIG. 3 is a sectional view taken on line A—A' of FIG. 2.
Figure 4:
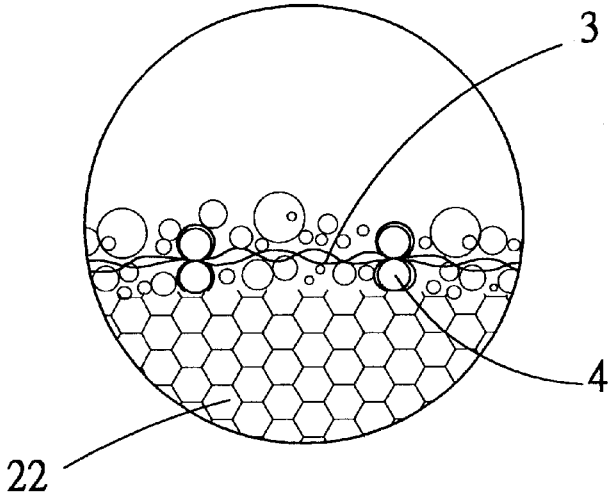
FIG. 4 is an enlarged fragmentary sectional view of FIG. 3.
Figure 5:
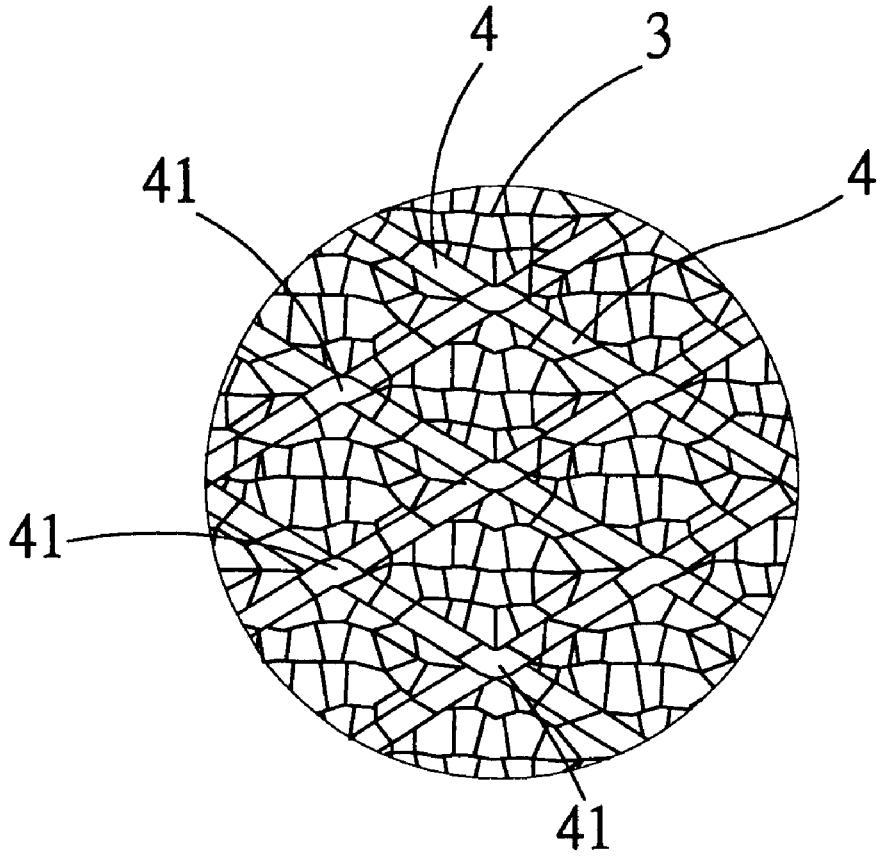
FIG. 5 is an enlarged top plan view of the area labelled B in FIG. 2.

Please refer to FIGS. 2 and 3 that are perspective and sectional views, respectively, of a bath scrubber 2 according to the present invention. As shown, the bath scrubber 2 mainly includes an outer bag 21 in which a suitably sized sponge 22 is received. The outer bag 21 is made of a fabric knitted or woven from yarns of twisted artificial fibers. The yarns are divided into thin yarns 3 and thick yarns 4. The thin yarns 3 are densely woven to constitute a base of the fabric while the thick yarns 4 are evenly distributed to form checked pattern among the thin yarns 3 on the fabric, as can be clearly seen from FIGS. 4 and 5. Any two opposite thick yarns 4 in the checked pattern on the fabric are parallel to one another, and any two adjacent thick yarns 4 in the checked pattern intersect one another and the intersections thereof are wound by tangled thin yarns 3 so that a plurality of solid knurls 41 are formed at the intersections of the thick yarns 4 throughout the fabric.

With the densely woven thin yarns 3 and the evenly distributed and intersected thick yarns 4, a plurality of small areas (that is, the base of the fabric woven from the thin yarns 3) forming different units of the checked pattern on the fabric have plain but coarse surfaces enclosed by raised thick borders (that is, the thick yarns 4).

When the bath scrubber 2 having the outer bag 21 made of the above-described fabric is used in a bath to clean a user's skin, the densely woven thin yarns 3 forming the plain but coarse small surfaces and the thick yarns 4 forming the raised borders of the small surfaces tend to cause the soap, either in solid or liquid form, applied on a surface of the outer bag 21 to produce increased amount of bubbles.

Therefore, a reduced amount of soap would be sufficient to thoroughly clean the user's body with the bath scrubber of the present invention. Moreover, bubbles in smaller size are produced mainly among the thin yarns 3 and bubbles in larger size are produced mainly among the raised borders formed of thick yarns 4, and both the smaller and the larger bubbles can gather and be held on the surface of the outer bag 21 of the bath scrubber of the present invention for a prolonged time. The bath scrubber of the present invention is therefore more convenient and practical for use.

Due to the difference in height between the lowered plain coarse surfaces and the raised thick borders on the surface of the outer bag 21, the bath scrubber of the present invention provides a rough but soft contact surface to effectively scour and massage the user's skin at the same time. The knurls 41 formed on the outer bag 21 at intersections of the thick yarns 4 are suitably spaced from one another and can easily reach any depressed areas on the user's body to thoroughly clean and massage the same.

Following are some advantages of the bath scrubber of the present invention:

1. The outer bag 21 of the bath scrubber is made of a fabric having a roughness sufficient for scouring the user's skin and a softness sufficient for reaching depressed areas on the user's body to thoroughly clean such areas. That is, the bath scrubber of the present invention is an effective cleaning device.
2. The specially woven fabric including densely distributed thin yarns and checked thick yarns has better ability of gathering and holding bubbles produced by liquid or solid soap. Therefore, only a reduced amount of soap is needed for cleaning purpose.
3. The checked raised thick yarns and the knurls formed at intersections thereof together produce good massage effect on the user's skin.

What is to be noted is the form of the present invention shown and disclosed is to be taken as a preferred embodiment of the invention. The raised thick yarns 4 in the fabric for forming the outer bag 21 of the bath scrubber are not necessarily to form checked pattern and enclose square, rectangular or rhombic areas on the fabric. It is also possible for the thick yarns 4 to enclose areas of other geometrical figures, such as triangles, pentagons or octagons. And, it is not necessary for both upper and lower sides of the outer bag 21 to be the fabric woven from thin and thick yarns of twisted artificial fibers. It is acceptable if only the upper or the lower side of the outer bag 21 is made of the fabric described herein. It is understood that various changes in the shape, size, and arrangements of parts may be resorted to without departing from the spirit of the invention or the scope of the subjoined claims.

What is claimed is:

1. A bath scrubber comprising:

an outer bag and a sponge received in said outer bag; wherein said outer bag comprises a fabric woven from a plurality of fibers, a base portion of said fabric being formed from densely woven thin yarn, said base portion is divided into a plurality of uniform geometric regions by thick yam interwoven therein, said thick yarn forming a plurality of intersections to define said geometric regions; such that said thick yarn protrudes above said thin yarn of said base portion, thereby providing said outer bag with a rough surface, said rough surface enables said bath scrubber to produce a desired cleaning and massaging effect when said outer bag contacts a user's skin.

2. The bath scrubber as claimed in claim 1, wherein: said geometric regions are regular polygons.

3. The bath scrubber as claimed in claim 1, wherein: said geometric regions are rhombuses.

4. The bath scrubber as claimed in claim 1, wherein: said geometric regions are triangles.

5. The bath scrubber as claimed in claim 1, wherein: said geometric regions are pentagons.

6. The bath scrubber as claimed in claim 1, wherein: said geometric regions are octagons.

7. The bath scrubber as claimed in claim 1, wherein: said thin yarn encircles said thick yarn at said intersections.

* * * * *